United States Patent [19]

Morris, Sr.

[11] Patent Number: 4,998,632

[45] Date of Patent: Mar. 12, 1991

[54] CONDITION INDICATING CHILD-RESISTANT CAP

[76] Inventor: Glenn H. Morris, Sr., 1192 Cumberland Rd., Chattanooga, Tenn. 37419

[21] Appl. No.: 428,775

[22] Filed: Oct. 30, 1989

[51] Int. Cl.[5] ..... B65D 55/02

[52] U.S. Cl. ..... 215/201; 215/219; 215/220

[58] Field of Search ..... 215/213, 218, 201, 203, 215/208, 216, 219, 220, 221, 301

[56] References Cited

U.S. PATENT DOCUMENTS

| | | | |
|---|---|---|---|
| 3,394,829 | 4/1967 | Peterson | 215/220 |
| 3,777,924 | 12/1973 | Kayser et al. | 215/201 |
| 3,795,338 | 3/1974 | Swartzbaugh et al. | 215/219 |
| 3,926,326 | 12/1975 | Grau | 215/218 |
| 4,020,965 | 5/1977 | Northup | 215/213 |
| 4,527,701 | 7/1985 | Schaubeck | 215/220 |
| 4,570,809 | 2/1986 | Archer | 215/220 |
| 4,832,218 | 5/1989 | Gibilisco | 215/221 |

*Primary Examiner*—Stephen Marcus

*Assistant Examiner*—Vanessa M. Roberts

*Attorney, Agent, or Firm*—Brady, O'Boyle & Gates

[57] ABSTRACT

A condition indicating child-resistant cap assembly including an inner cap and an outer cap rotatably mounted on the inner cap. An indicating post is connected to the top wall of the inner cap in alignment with an opening in the top wall of the outer cap. When the cap assembly is in the child-resistant mode, the outer cap is spaced upwardly from the inner cap and is freely rotatable in one direction thereon. The post is wholly contained within the space between the inner and outer caps and therefore not visible outside the cap assembly to indicate the cap assembly is in the child-resistant mode. When the cap assembly is in the non-child-resistant mode, the outer cap is rotated in the opposite direction until it snaps, and is moved downwardly toward the inner cap and rotated in the first mentioned direction, whereby the inner and outer caps are interlocked for removal from a container. The post extends outwardly of the cap assembly and therefore is visible to indicate that the cap assembly is in the non-child-resistant mode.

20 Claims, 2 Drawing Sheets

FIG. 9
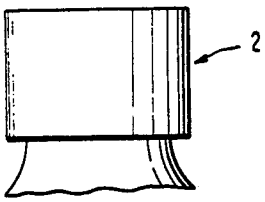
FIG. 12
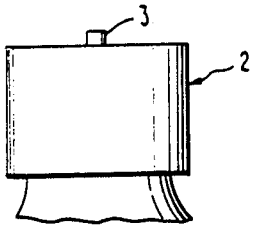
FIG. 10
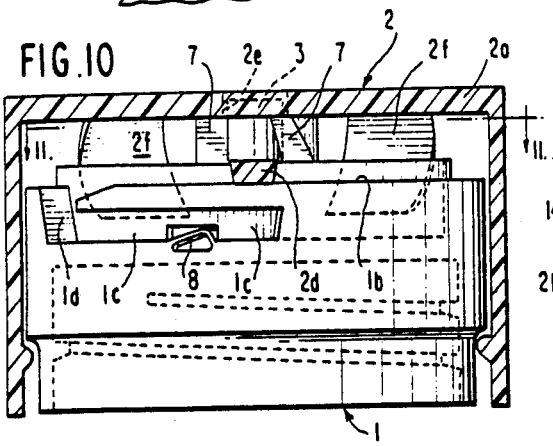
FIG. 13
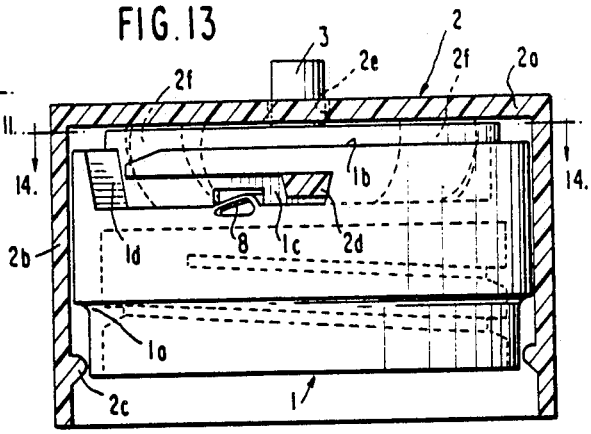
FIG. 11
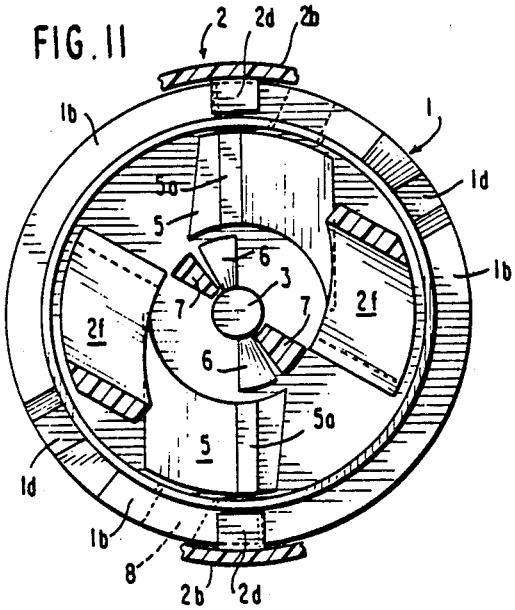
FIG. 14
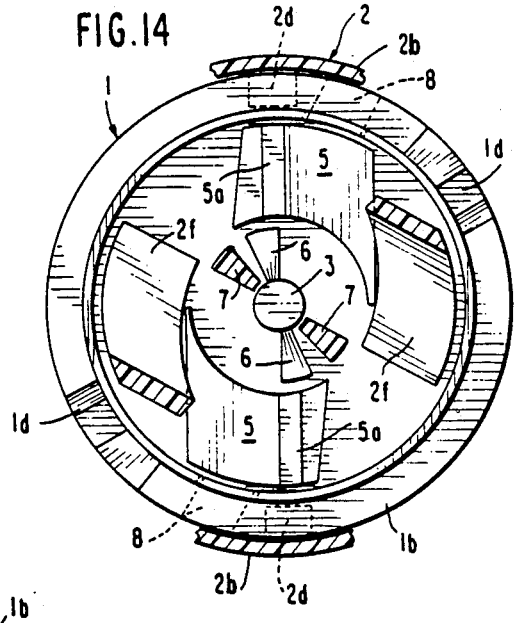
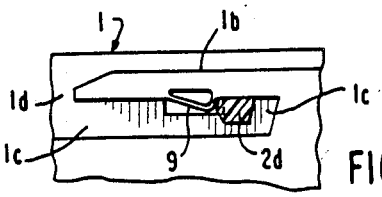
FIG. 15

CONDITION INDICATING CHILD-RESISTANT CAP

BACKGROUND OF THE INVENTION:

Various safety caps have been proposed to prevent children from opening containers containing medicines and pills. These safety caps have been constructed and arranged so that when placed on the container, they are very difficult to remove, and generally require a manipulation which has been found to be not only difficult for a child but also for an adult. Because of the difficulty in removing the safety cap, often times it will be replaced on the container in a non-child-resistant condition, and forgotten. To warn the user that a cap is on the container in a non-child-resistant condition, some safety caps have been provided with indicators.

After considerable research and experimentation, the child-resistant cap of the present invention has been devised which renders the cap difficult for a child to remove from a medicine container, when in the child-resistant mode, but which can be manipulated to a non-child-resistant mode for ease of removing the cap from and replacing it on a medicine container by an adult. The cap is also provided with an indicator to show the particular mode of the cap.

The cap of the present invention is of the type disclosed in U.S. Pat. No. 3,394,829 wherein an inner cap is threadably mounted on the neck portion of a container, and a spring biased outer cap is mounted on the inner cap and fully rotatable thereon when in the child-resistant mode. Upon pushing the outer cap toward the inner cap against the biasing force of the spring, while rotating the outer cap, the inner and outer caps are connected in a locking relationship, whereby the inner cap and associated outer cap can be unthreaded from the neck portion of the container.

While the safety cap disclosed in the above-mentioned patent is satisfactory for its intended purpose, the operative arrangement of the various components employed in the cap results in the components becoming worn in a short period of time, thereby compromising the safety feature of the cap. For instance, the spring employed in the cap in the aforementioned patent is always in a biasing condition between the inner and outer caps causing the spring to eventually lose its biasing force memory. Also, the locking engagement of the outer and inner caps is provided by a tongue provided on the outer cap engageable with a groove provided in the inner cap; the frictional resistance between the tongue and groove being relied upon to hold the inner and outer caps in locked engagement for threading the cap back onto the bottle neck. The mating surfaces of the tongue and groove become worn resulting in a loss of the frictional resistance therebetween, thereby preventing the return of the safety cap on the bottle neck.

Furthermore, the safety cap disclosed in the above-mentioned patent does not include an indicator to show the child-resistant and non-child-resistant modes of the safety cap.

To overcome the disadvantages experienced with the above-noted safety cap, the condition indicating child-resistant cap of the present invention has been devised which comprises, essentially, an inner cap adapted to be threadably mounted on the neck of a medicine bottle, and an outer cap mounted on the inner cap. The outer cap has a pair of radially inwardly extending, diametrically opposed, flanges, or lugs, formed on the inner wall surface thereof and engageable with the peripheral edge portion of the top wall of the inner cap, to thereby hold the outer cap upwardly in spaced relationship to the inner cap, whereby the outer cap is freely rotatable on the inner cap, when the cap is in a child-resistant mode.

A pair of diametrically opposed groove configurations are formed in the outer circumferential wall surface of the inner cap in proximity to the top wall thereof and adapted to receive the outer cap flanges, whereby the outer cap may be moved downwardly and rotatably into interlocking engagement with the inner cap, to thereby place the cap in a non-child-resistant mode, wherein the cap can be unthreaded from the neck of the bottle. An elliptical spring is provided in each groove configuration and are adapted to engage the cap flanges to facilitate re-threading the cap on the bottle and to maintain the cap in the non-child-resistant mode.

A vertically extending post is mounted on the top wall of the inner cap in alignment with an opening provided in the top wall of the outer cap, whereby when the cap is in the child-resistant mode, the post is positioned within the space between the inner and outer cap and is not visible outside of the cap, to thereby indicate the child-resistant mode of the cap. The post is adapted to extend through the opening in the outer cap, when the outer cap is moved inwardly to interlocked position with the inner cap, and therefore visible outside the cap, to thereby indicate the non-child-resistant mode of the cap.

A pair of arcuate spring legs are integrally connected to the inner surface of the top wall of the outer cap and depend therefrom in a direction toward the outer surface of the top wall of the inner cap. The lower end portion of the spring legs are held spaced from the top wall of the inner cap when the cap is in the child-resistant mode by the outer cap flanges engaging and sliding on the peripheral edge portion of the inner cap, but engageable with the top wall of the inner cap to provide a biasing force to the outer cap flanges within the groove configurations when the cap is in the non-child-resistant mode.

A pair of upwardly extending ramps are integrally connected to the top wall of the inner cap and cooperate with the free ends of the depending spring legs to not only facilitate the movement of the outer cap flanges out of the groove configurations when the cap is being moved to the child-resistant mode but also to maintain the cap in the child-resistant mode wherein the outer cap is freely rotatable on the inner cap.

To further facilitate the outward movement of the outer cap relative to the inner cap a pair of upwardly-extending oppositely disposed inclined ramps are integrally mounted on the top wall of the inner cap on each side of indicator post and cooperate with a similarly configured pair of depending ramps integrally connected to the bottom wall surface of the outer cap adjacent the peripheral edge of the post receiving opening.

BRIEF DESCRIPTION OF THE DRAWINGS

FIG. 9 is a side elevational view of the child-resistant cap on a container, showing the cap in the child-resistant position;

FIG. 10 is a view similar to FIG. 1 showing the cap in the child-resistant position;

FIG. 11 is a horizontal cross-sectional view similar to FIG. 2, with parts omitted, showing the cap in the child-resistant position, the view being taken substantially along the line 11—11 of FIG. 10;

FIG. 12 is a side elevational view of the child-resistant cap on a container, showing the cap in the non-child-resistant position with the warning indicator protruding from the top of the cap;

FIG. 13 is a view similar to FIG. 10 showing the cap in the non-child-resistant position;

FIG. 14 is a view similar to FIG. 11 showing the cap in the non-child-resistant position, the view being taken substantially along line 14—14 of FIG. 13; and FIG. 15 is a fragmentary side elevational view, similar to FIG. 7 showing a modified position for the spring element.

DESCRIPTION OF THE PREFERRED EMBODIMENT

Figure 1:
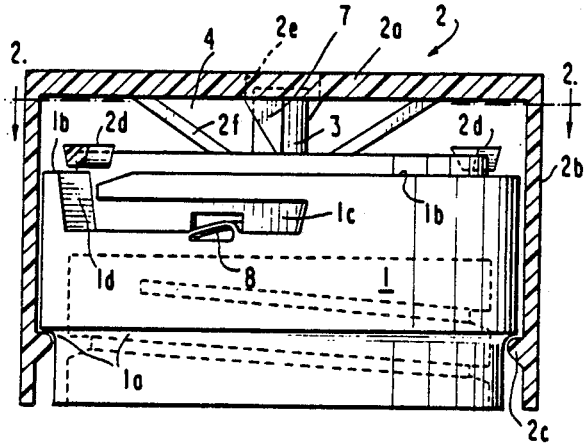
FIG. 1 is a side view of the condition indicating child-resistant cap of the invention, showing the inner cap in side elevation and the outer cap in cross-section, the view being taken substantially along line 1—1 of FIG. 2.
Figure 3:
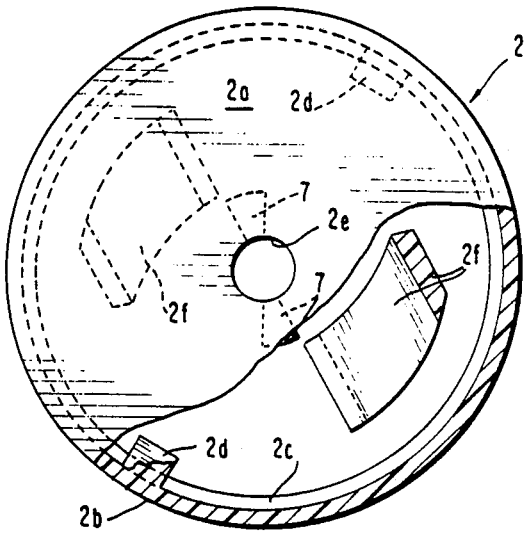
FIG. 3 is a top plan view, partly in section, of the outer cap alone.

Referring to the drawings and more particularly to FIG. 1, the condition indicating child-resistant cap of the present invention comprises an inner cap 1, adapted to be threadably mounted on the neck of a medicine bottle, not shown, and an outer cap 2 having a top wall 2*a*, and a depending side wall 2*b*, provided, at its lower end, with an inwardly extending annular bead 2*c* engageable with a similarly configured shoulder 1*a* provided on the outer wall surface of the inner cap 1, whereby the inner and outer caps 1 and 2, are interconnected and rotatable relative to each other.

The outer cap 2 is provided with a pair of radially, inwardly extending, diametrically opposed flanges or lugs 2*d* formed on the inner wall surface of the outer cap side wall 2*b* and engageable with a peripheral edge portion 1*b* of the top wall of the inner cap 1, whereby the outer cap 2 is held upwardly in spaced relationship to the inner cap 1, and the cap assembly is in a child-resistant mode, wherein the outer cap 2 is freely rotatable on the inner cap 1.

The side wall of the inner cap 1 is provided with a pair of circumferentially extending slots 1*c*, each of which communicate at one end thereof with an upwardly inclined slot 1*d* extending through the peripheral edge portion 1*b*.

A vertically extending post 3 is fixedly mounted on the top wall of the inner cap 1 and is in alignment with an opening 2*e* provided in the top wall of the outer cap 2, whereby when the cap is in the child-resistant mode, the post 3 is positioned within the space 4 between the top walls of the inner and outer caps 1 and 2, and below the top of opening 2*e*, and, therefore, not visible outside of the cap, to thereby indicate the child-resistant mode of the cap, as shown in FIGS. 1, 9, and 10. The post 3 is adapted to extend through the opening 2*e* in the outer cap 2 and above the top wall 2*a* thereof, when the outer cap 2 has been moved inwardly to an interlocked position with the inner cap, to be described more fully hereinafter, and therefore visible outside the cap, to thereby indicate the non-child-resistant mode of the cap, as shown in FIGS. 12 and 13.

A pair of arcuate spring legs 2*f* are integrally connected to the inner surface of the top wall 2*a* of the outer cap and depend therefrom in a direction toward the outer surface of the top wall of the inner cap 1. As will be seen in FIG. 10, the lower end portions of the spring legs 2*f* are spaced from the top wall of the inner cap when the cap is in the child-resistant mode, but engageable with the top wall of the inner cap to provide an upwardly biasing force to the outer cap lugs 2*d* within the circumferential slots 1*c*, as shown in FIG. 13, when the cap is in the non-child-resistant mode.

Figure 5:
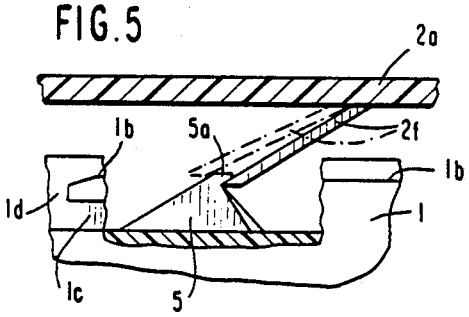
FIG. 5 is a fragmentary side elevational view, partly in section, taken substantially along arcuate line 5—5 of FIG. 2.
Figure 4:
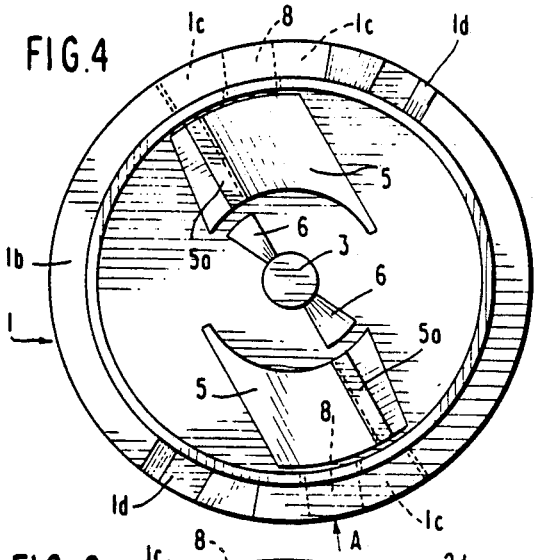
FIG. 4 is a top plan view of the inner cap alone
Figure 2:
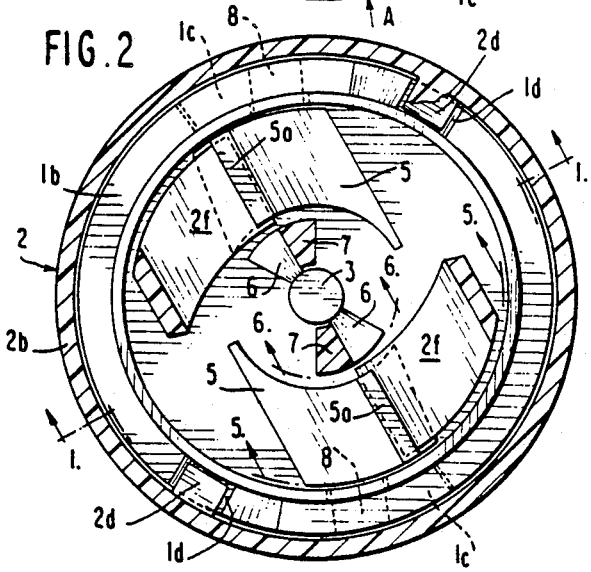
FIG. 2 is a transverse cross-sectional view taken substantially along line 2—2 of FIG. 1 and showing the locking lugs in position for manipulating the cap to the non-child-resistant position.

Referring to FIGS. 2, 4, and 5, a pair of upwardly extending ramps 5 are integrally connected to the top wall of the inner cap in proximity to the inclined slots 1*d* extending through the peripheral edge portion 1*b* of the inner cap 1. The back sides of ramps 5, that is the side shown to the left, cooperate with the free ends of the depending spring legs 2*f*, as shown in phantom in FIG. 5, to prevent the lugs 2*d* from dropping into the inclined slots 1*d* during the counter-clockwise rotation of the outer cap 2 while the cap is being maintained in the child-resistant mode. A lip 5*a* is provided on the top of each ramp 5. The ramp 5 and spring legs 2*f* are positioned to engage as the lugs 2*d* arrive at the gap in edge portion 1*b* formed by the top of the upwardly inclined slots 1*d*, and the free ends of spring legs 2*f* sliding up the back sides of the ramps 5 and over the lip portion 5*a* hold outer cap 2 upwardly in spaced relation to inner cap 1 as lugs 2*d* travel over the gap, thus maintaining the cap in the child-resistant mode as the outer cap 2 is continually rotated counter-clockwise.

To interlock the inner and outer caps 1 and 2, the outer cap is rotated clockwise relative to the inner cap until the free ends of spring legs 2*f* engage the front sides of ramps 5, that is the side shown to the right in FIG. 5. The free ends of the spring legs 2*f* slide up the ramps and engage beneath the lips 5*a*, as shown in full lines in FIG. 5, and this stops further clockwise rotation of the outer cap and at this position, the lugs 2*d* become aligned with their respective inclined slots 1*d*. This stopping motion indicates to the user that the inner and outer caps 1 and 2 are aligned for manipulation to the non-child-resistant position. The outer cap is then pushed downwardly thereby moving each lug 2*d* down the inclined slot 1*d*, as the free end of each spring leg 2*f* moves back down the front side of the respective ramp 5, aligning each lug 2*d* with the open end of its respective circumferentially extending slot 1*c*. The post 3 simultaneously extends through opening 2*e* in the outer cap. The outer cap 2 is then rotated counter-clockwise, to thereby move the lugs 2*d* into abutment with the closed ends of the slots 1*c*, as shown in FIGS. 13 and 14, whereby the inner and outer caps become interlocked in the non-child-resistant position, and further counter-clockwise rotation allows the inner cap 1 to be removed or unscrewed from the bottle or container.

When the outer cap 2 is rotated clockwise from a non-child-resistant mode to the child-resistant mode as when screwing the cap back onto the container, as the inner cap 1 tightens on the thread of the container, the lugs 2*d* move to the left in circumferential slots 1*c* and contact the end inclined walls of inclined slots 1*d*, thus further tightening inner cap 1 on the container. During this movement the spring legs 2*f* will have moved from the biasing position shown in FIG. 13 to the position shown in FIG. 5 wherein the free ends of the spring legs 2*f* will have simultaneously moved upwardly on the front inclined surfaces of the ramps 5 to engagement under the lip portions 5*a*, thus simultaneously biasing the lugs 2*d* upwardly within the inclined slots 1*d* to the peripheral edge portion 1*b*. The cap is now in the child-resistant mode and post 3 is positioned below the top wall 2*a* of the outer cap. Thereafter, counter-clockwise rotation of the outer cap causes it to freely rotate on inner cap 1 as previously described.

Each time the free ends of the depending spring legs 2*f* engage beneath the lip portion 5*a* a downward force is imparted to the spring legs 2*f* that pulls them downwardly away from the inner surface of the top wall 2*a* of the outer cap 2 from which they depend thus straightening the spring legs and returning memory to them that may have been diminished when moving to and from the non-child-resistant mode.

By the construction and arrangement of the free ends of the depending spring legs 2*f* cooperating with the ramps 5, the cap is maintained in the child-resistant mode wherein the outer cap 2 is freely rotatable on the inner cap 1, and the movement of the lugs 2*d* from the circumferential slots 1*c* to the inclined slots 1*d* and upwardly therefrom is facilitated when the cap is being moved to the child-resistant mode.

Figure 6:
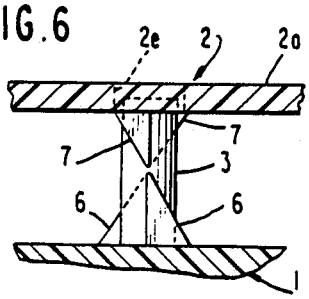
FIG. 6 is fragmentary side elevational view, partly in section, taken substantially along arcuate line 6—6 of FIG. 2.

To further facilitate the outward movement of the outer cap 2 relative to the inner cap 1, when moving to the child-resistant mode, as will be seen in FIG. 6, a pair of upwardly-extending oppositely disposed inclined ramps 6 are integrally mounted on the top wall of the inner cap 1 on each side of the indicator post 3 and cooperate with a similarly configured pair of depending ramps 7 integrally connected to the bottom wall surface of the outer cap 2 adjacent the peripheral edge of the post receiving opening 2*e*. These ramps 6 and 7 are radially positioned to engage each other, when moving from the non-child resistant position to the child resistant position at the same times that the free ends of the depending spring legs 2*f* engage the front inclined surfaces of the ramps 5, and that lugs 2*d* engage the end inclined walls of inclined slots 1*d*, all cooperating to tighten inner cap 1 on the container and move outer cap 2 upwardly away from inner cap 1 to the child-resistant position.

In order to increase the frictional resistance of the lugs 2*d* positioned within the circumferential slots 1*c*, as shown in FIG. 13, while maintaining the cap in the non-child-resistant mode, elliptical springs 8 are integrally formed through the side wall of inner cap 1 and on the bottom wall edges of the circumferential slots 1*c* and are adapted to be engaged and flexed by the lugs 2*d* to thereby retard the movement of the outer cap 2 when being rotated to the child-resistant mode. The space between the top wall edges of the circumferential slots 1*c* and the elliptical springs 8 is somewhat less than the vertical thickness of the lugs 2*d*, so the elliptical springs must flex slightly to allow passage of the lugs 2*d*. The contacting surfaces of the lugs 2*d* and elliptical springs are contoured accordingly to provide the required camming action. The additional frictional resistance thus provided optionally allows the inner cap 1 to be partially tightened on the container while remaining in the non-child-resistant position which is indicated by the extended condition indicating or warning post 3. To move the cap to the child-resistant position one merely has to further rotate the outer cap 2 clockwise. When this option feature is not used, and the cap is being normally manipulated from the non-child-resistant position to the child-resistant position, the increased frictional resistance to the lugs from the elliptical springs during clockwise rotation of the outer cap causes one to apply slightly more clockwise rotation pressure, and as the lugs squeeze past the elliptical springs and the torque pressure is released, greater pressure is thus applied to tightening the inner cap on the container as the lugs 2*d* contact the inclined end walls of inclined slots 1*d*, etc., thus insuring quick return t the child-resistant condition.

Figure 7:
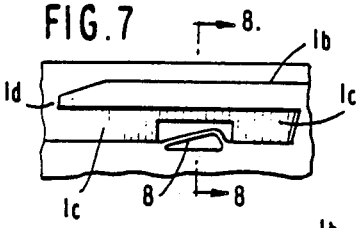
FIG. 7 is a fragmentary side elevational view taken in the direction of arrow A in FIG. 4.
Figure 8:
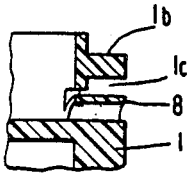
FIG. 8 is a vertical cross-sectional view taken substantially along line 8—8 of FIG. 7.

While FIG. 7 shows the elliptical springs 8 on the bottom wall edge of the circumferential slots 1*c*, FIG. 15 illustrates a modification wherein the elliptical springs 9 are integrally formed on the top wall edge of the circumferential slots 1*c* and through the side wall of inner cap 1. In this form lugs 2*d* do not squeeze past the elliptical springs but ride over them; by being cammed downwardly by the flexible elliptical springs which also causes compression of the spring legs 2*f* as lugs 2*d* move out of slots 1*c*.

In the operation of the condition indicating child-resistant cap of the present invention, when the outer cap 2 is spaced outwardly from the inner cap as shown in FIGS. 1, 9, and 10, the post 3 is not visible, thereby indicating that the cap is in the child-resistant mode wherein the outer cap 2 is freely rotatable on the inner cap 1, and therefore, the cap cannot be removed from the bottle without the required manipulation. The cap is maintained in this child-resistant mode by the lugs 2*d* engaging the peripheral surface 1*b* of the inner cap 1, and the free ends of the spring legs 2*f* engaging the ramps 5 and the lip portions 5*a* thereof when the lugs 2*d* become aligned with the inclined slots 1*d*.

To manipulate the cap to the non-child-resistant mode, as shown in FIGS. 12 and 13, the outer cap 2 is rotated clockwise until it stops by the free ends of the spring legs 2*f* engaging under the lip portions 5*a* of ramp 5. The lugs 2*d* are in aligned position with the inclined slots 1*d* and they move downwardly therein as the outer cap 2 is pushed downwardly and rotated counter-clockwise. Continued counter-clockwise rotation of the outer cap 2 will cause the lugs 2*d* to move past the elliptical springs 8 to the closed end of the circumferential slots 1*c*. The post 3 extends outwardly of the cap to indicate that the cap is in the non-child-resistant mode. The biasing force of the spring legs 2*f* will force the lugs 2*d* upwardly against the top wall edge of the circumferential slot 1*c*, whereby the inner and outer caps are interlocked and the cap is maintained in the non-child-resistant mode. Further counter-clockwise rotation of the outer cap 2 through lugs 2*d* unscrews inner cap 1 to remove it from a medicine bottle or container in the same manner as a regular threaded cap, and the cap can be applied to a container in the same manner as a regular threaded cap.

The terms and expression s which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A child-resistant cap assembly comprising, an inner cap adapted to be threadably mounted on a container, an outer cap mounted on said inner cap, means interconnecting the inner and outer caps, whereby the inner cap is captivated within the outer cap and they are movable axially and freely rotatable relative to each other, the inner cap having a top wall and a depending side wall, said top wall of said inner cap having a peripheral edge portion, said outer cap having a top wall and a depending side wall, radially inwardly extending flange means on the inner wall surface of the outer cap side wall, said flange means engaging the peripheral edge portion of the top wall of the inner cap, whereby the outer cap is held upwardly in spaced relationship to the inner cap, and the cap assembly is in a child-resistant mode, wherein the outer cap is freely rotatable on the inner cap.

2. A child-resistant cap assembly according to claim 1, wherein the means interconnecting the inner cap and the outer cap comprises, an inwardly extending annular bead on the lower end portion of the side wall of the outer cap, said annular bead being engageable with a similarly configured shoulder provided on the outer wall surface of the inner cap.

3. A child-resistant cap assembly according to claim 1, wherein the flange means comprises a pair of radially, inwardly extending, diametrically opposed lugs.

4. A child-resistant cap assembly according to claim 1, wherein slot means are formed in the side wall of said inner cap communicating with the peripheral edge portion of the inner cap, said flange means being receivable in said slot means, whereby the outer cap is moved downwardly, into interlocked engagement with the inner cap and the cap assembly is in the non-child-resistant mode.

5. A child-resistant cap assembly according to claim 4, wherein the slot means comprises a pair of circumferentially extending slots, each slot having one end closed and the other end communicating with an upwardly extending slot extending through the peripheral edge portion of the inner cap.

6. A child-resistant cap assembly according to claim 1, wherein spring means are integrally connected to the inner surface of the top wall of the outer cap and depend therefrom in a direction toward the outer surface of the top wall of the inner cap, the lower end portions of the springs means being spaced from the top wall of the inner cap when the cap assembly is in the child-resistant mode.

7. A child-resistant cap assembly according to claim 1, wherein spring means are integrally connected to the inner surface of the top wall of the outer cap and depend therefrom in a direction toward the outer surface of the top wall of the inner cap, the lower end portions of the spring means engaging the top wall of the inner cap, to thereby provide an upwardly biasing force to the outer cap flange means within said slot means when the cap assembly is in the non-child-resistant mode.

8. A child-resistant cap assembly according to claim 6, wherein the spring means comprises, a pair of arcuate spring legs.

9. A child-resistant cap assembly according to claim 5, wherein spring means are positioned within said circumferentially extending slots and adapted to be engaged by said flange means, to thereby increase the frictional resistance of the flange means within the slot means while the cap assembly is being maintained in the non-child-resistant mode.

10. A child-resistant cap assembly according to claim 9, wherein the spring means comprises a pair of elliptical springs formed on the bottom wall edge of each circumferential slot.

11. A child-resistant cap assembly according to claim 9, wherein the spring means comprises a pair of elliptical springs formed on the top wall edge of each circumferential slot.

12. A child-resistant cap assembly according to claim 5, wherein spring means are integrally connected to the inner surface of the top wall of the outer cap and depend therefrom in a direction toward the outer surface of the top wall of the inner cap, the lower end portions of the spring means being spaced from the top wall of the inner cap when the cap assembly is in the child-resistant mode, and ramp means mounted in the top wall of said inner cap radially coordinated with the upwardly extending slots, the lower end portions of the spring means being engageable with the ramp means to thereby prevent the flange means from dropping into the upwardly extending slots during the rotation of the outer cap while the cap assembly is being maintained in the child-resistant mode.

13. A child-resistant cap assembly according to claim 12, in which said ramp means includes a rear upwardly sloping ramp portion and top lip portion engageable by said lower end portions of said spring means during counterclockwise rotation of the outer cap on the inner cap in the child-resistant mode.

14. A child-resistant cap assembly according to claim 12, in which said ramp means includes a front upwardly sloping ramp portion and a top lip portion above said front upwardly sloping ramp portion, said lower end portions of said spring means during clockwise rotation of the outer cap on the inner cap engaging beneath said top lip portion stopping rotation of said outer cap on said inner cap.

15. A child-resistant cap assembly according to claim 14, and said flange means positioned above said upwardly extending slots when said lower end portions of said spring means are engaged beneath said to lip portion.

16. A child-resistant cap assembly according to claim 15, including at least a pair of spaced cooperating inclined members, one of said inclined members connected to the inner surface of the top wall of the outer cap and depending therefrom, and the other of said inclined members connected to the top wall of said inner cap, said pair of spaced cooperating inclined members when said lower end portions of said spring means engage beneath said top lip portion positioned to move into contact when said outer cap moves downwardly toward said inner cap.

17. A condition indicating child-resistant cap assembly, comprising an inner cap adapted to be threadably mounted on a container, an outer cap mounted on said inner cap, means interconnecting the inner and outer caps, whereby the inner cap is captivated within the outer cap and they are moveable axially and freely rotatable relative to each other, the inner cap having a top wall and a depending side wall, said top wall of said inner cap having a peripheral edge portion, said outer cap having a top wall and a depending side wall, radially inwardly extending flange means on the inner wall surface of the outer cap side wall, said flange means engaging the peripheral edge portion of the top wall of the inner cap, whereby the outer cap is held upwardly in spaced relationship to the inner cap, and the cap assembly is in a child-resistant mode, wherein the outer cap is freely rotatable on the inner cap; and a vertically extending post secured to the top wall of the inner cap, an opening provided in the top wall of the outer cap in alignment with said post, said post being wholly contained within the space between the top walls of the inner and outer caps and therefore not visible outside of the cap, to thereby indicate the child-resistant mode of the cap.

18. A condition indicating child-resistant cap assembly according to claim 17, wherein slot means are formed in the side wall of said inner cap communicating with the peripheral edge portion of the inner cap, said flange means being receivable in said slot means, whereby the outer cap is moved downwardly into interlocked engagement with the inner cap, and the cap assembly is in the non-child-resistant mode, said post extending outwardly of the cap assembly through said opening, to thereby be visible outside the cap to indicate the non-child-resistant mode of the cap assembly.

19. A condition indicating child-resistant cap assembly according to claim 17, wherein a pair of upwardly extending oppositely disposed inclined ramps are secured to the top wall of the inner cap on each side of said post, a pair of similarly configured depending ramps connected to the bottom wall surface of the outer cap adjacent the peripheral edge of the opening, said pairs of ramps cooperating with each other to facilitate the outward movement of the outer cap when the cap assembly is being moved to the child-resistant mode.

20. A condition indication child-resistant cap assembly, comprising an inner cap adapted to be threadably mounted on a container, an outer cap mounted on said inner cap, means interconnecting the inner and outer caps, whereby the inner cap is captivated within the outer cap and they are moveable axially and freely rotatable relative to each other, the inner cap having a top wall, said outer cap having a top wall, child-resistant coupling means having a child-resistant mode and a non-child-resistant mode, said child-resistant coupling means connected between said inner cap and said outer cap operative to retain said outer cap held upwardly in spaced relationship to the inner cap when the cap assembly is in the child-resistant mode, wherein the outer cap is freely rotatable on the inner cap, a vertically extending post secured to the top wall of the inner cap, an opening provided in the top wall of the outer cap in alignment with said post, said post being wholly contained within the space between the top walls of the inner and outer caps and therefore not visible outside of the cap to thereby indicate the child-resistant mode of the cap, said child-resistant coupling means in the non-child-resistant mode operative to allow said outer cap to move axially downwardly into interlocked engagement with said inner cap, whereby said post extends outwardly of the cap assembly through said opening to be visible outside the cap to indicate the non-child-resistant mode of the cap assembly.

* * * * *